United States Patent [19]

Itakura et al.

[11] 4,393,272

[45] Jul. 12, 1983

[54] SOUND SYNTHESIZER

[75] Inventors: Fumitada Itakura, Houya; Noboru Sugamura, Iruma, both of Japan

[73] Assignee: Nippon Telegraph and Telephone Public Corporation, Tokyo, Japan

[21] Appl. No.: 188,782

[22] Filed: Sep. 19, 1980

[30] Foreign Application Priority Data

Oct. 3, 1979 [JP] Japan ..... 54-128365

[51] Int. Cl.[3] ..... G10L 1/00

[52] U.S. Cl. ..... 179/1 SA; 179/1 SM; 364/724

[58] Field of Search ..... 179/1 SA, 1 SM, 1 SG, 179/15.55 R, 15.5 ST; 364/724, 725; 333/28 R, 166; 84/1.01

[56] References Cited

U.S. PATENT DOCUMENTS 4,064,363 12/1977 Malm ..... 179/1 SA 4,125,898 11/1978 De Hart et al. ..... 179/1 SM

OTHER PUBLICATIONS

Cappolini, "Design of Some Digital Filters", Symposium, Polytechnic Institute of Brooklyn, Apr. 1969, pp. 313 and 320.

Flanagan, "Speech Analysis, Synthesis and Perception", Springer-Verlag, 1972.

R. Shafer et al., "Digital Representations of Signals", Proc. IEEE, Apr., 1975, pp. 662, 663.

L. Rabiner et al., "FIR Digital Filter etc.", Proc. IEEE, Apr., 1975, pp. 595, 600.

S. Freeny, "Special Purpose Hardware for Digital Filtering", Proc. IEEE, Apr., 1975, pp. 633, 634.

*Primary Examiner*—Emanuel S. Kemeny

*Attorney, Agent, or Firm*—Pollock, Vande Sande & Priddy

[57] ABSTRACT

The spectral envelope of speech signals are characterized by LSP (line spectral pair) parameters, termed $w_i$ and $\theta_i$. In a speech synthesizer the control parameters for the filter may be $a_i = -2 \cos w_i$ and $b_i = -2 \cos \theta_i$. The synthesizer filter is essentially an all pole filter consisting of two feedback paths each of which has a transfer function having zeroes on a unit circle in the complex plane.

27 Claims, 30 Drawing Figures

SOUND SYNTHESIZER

BACKGROUND OF THE INVENTION

The present invention relates to a second synthesizer with which it is possible to reconstruct a sound of substantially the same quality as an original sound from its features transmitted or stored in a memory in a small amount of information.

For example, in the case of reconstructing speech from feature parameters of original speech, according to the prior art the output of a pulse generator simulating the vibration of the vocal cord and the output of a noise generator simulating turbulence are changed over or mixed together depending on whether the speech is voiced or unvoiced and the resulting output is amplitude-modulated in accordance with the speech amplitude to produce an excitation source signal which is applied to a filter simulating the resonance characteristics of the vocal tract to obtain synthesized speech. A synthesis system using partial auto correlation (PARCOR) coefficients and a formant synthesis system are examples of such speech synthesis system employing the feature parameters. The former is set forth, for example, in J. D. Markel et al., "Linear Prediction of Speech", pages 92–128, Springer-Verlag, 1976, in which the partial auto correlation coefficients or the so-called PARCOR coefficients of a speech waveform are used as the feature parameters. If the absolute values of the PARCOR coefficients are all smaller than unity, the speech synthesizing filter is stable. The PARCOR coefficients may be relatively small in the amount of information for speech synthesis and the automatic extraction of the coefficients is relatively easy, but the individual parameters differ widely in the spectral sensitivity. Accordingly, if all the parameters are quantized using the same number of bits, spectral distortions caused by quantization errors for the respective parameters largely differ from each other. Further, the PARCOR coefficients are poor in their interpolation characteristics and, by the interpolation of the parameters, there are produced noises, resulting in an indistinct speech. Especially at a low bit rate, the speech quality is deteriorated by the spectral distortion and no satisfactory synthesized speech quality is obtainable. In addition, the PARCOR coefficients do not directly correspond to spectral properties such as formant frequencies, and hence the PARCOR coefficients are not suitable for speech synthesis by rule.

The formant synthesis system is disclosed, for example, in J. L. Flanagan, "Speech Analysis, Synthesis and Perception", pages 339–347, Springer-Verlag, 1972. This system is one which synthesizes speech using the formant frequencies and their intensity as parameters and which is advantageous in that the amount of information for the parameters may be small and in that the correspondence of the parameters to spectral quantities is easy to obtain. For the extraction of the formant frequency and the intensity thereof, however, it is necessary to make use of general dynamic characteristics and statistical properties of the parameters, and complete automatic extraction of the formant frequency and the intensity thereof is difficult. Accordingly, it is difficult to automatically obtain synthesized speech of high quality and it is likely to markedly degrade the quality of the synthesized speech by an error in the extraction of the parameters.

It is an object of the present invention to provide a sound synthesizer which is able to synthesize a sound of high quality using a small amount of information.

Another object of the present invention is to provide a sound synthesizer which permits relatively easy extraction of the feature parameters and operates stably and in which differences in the spectral sensitivity among the parameters are small and the quantization accuracy of the parameters is the same in the case of the same quantization bits.

Another object of the present invention is to provide a sound synthesizer which is excellent in interpolation characteristics for parameters used and hence is able to obtain a synthesized sound of high quality with a small amount of information.

Yet another object of the present invention is to provide a sound synthesizer which can be produced in a relatively simple structure.

SUMMARY OF THE INVENTION

In a linear predictive analysis, the speech spectral envelope is approximated by a transfer function of an all-pole filter which is given by the following expression (1):

$$H(Z) = \frac{\sigma}{A_p(Z)} = \frac{\sigma}{1 + \alpha_1 Z + \alpha_2 Z^2 + \ldots + \alpha_p Z^p} \quad (1)$$

where $Z = e^{-j\omega}$, $\omega$ is a normalized angular frequency $2\pi f\Delta T$, $\Delta T$ is a sampling period, f is a sampling frequency, p is the degree of analysis, $\alpha_i (i = 1, 2, \ldots p)$ are predictor coefficients which are parameters for controlling the resonance characteristic of the filter and $\sigma$ is the gain of the filter. Here, $A_p(Z)$ is represented by the sum of two polynomials which can be expressed as follows:

$$A_p(Z) = \tfrac{1}{2}\{P(Z) + Q(Z)\} \quad (2)$$

$$P(Z) = A_p(Z) - Z \cdot Z^p A_p(Z^{-1}) \quad (3)$$

$$Q(Z) = A_p(i\ Z) + Z \cdot Z^p A_p(Z^{31\ 1}) \quad (4)$$

(a) When the degree of analysis p is even, the expressions (3) and (4) are factorized as follows:

$$\begin{cases} P(Z) = (1 - Z) \prod_{i=1}^{p/2} (1 - 2\cos\omega_i Z + Z^2) \\ Q(Z) = (1 + Z) \prod_{i=1}^{p/2} (1 - 2\cos\theta_i Z + Z^2) \end{cases} \quad (5)$$

(b) When the degree of analysis p is odd, the expressions (3) and (4) are factorized as follows:

$$\begin{cases} P(Z) = (1 - Z^2) \prod_{i=1}^{(p-1)/2} (1 - 2\cos\omega_i Z + Z^2) \\ Q(Z) = \prod_{i=1}^{(p+1)/2} (1 - 2\cos\theta_i Z + Z^2) \end{cases} \quad (6)$$

$\omega_i$ and $\theta_i$ in the expressions (5) and (6) are called a line spectrum pair (hereinafter referred to as LSP) and in the present invention, they are used as parameters for representing spectral envelope information.

Expressing $A_p(Z)$ as given by th expression (2), the transfer function H(Z) becomes as follows:

$$H(Z) = \frac{\sigma}{A_p(Z)} = \frac{\sigma}{1 + (A_p(Z) - 1)} = \frac{\sigma}{1 + \frac{1}{2}\{P(Z) - 1 + Q(Z) - 1\}} \quad (7)$$

As will be seen from expression (7), the transfer function H(Z) is also formed as a filter having two feedback loops whose transfer functions are P(Z)−1 and Q(Z)−1, respectively. The transfer functions P(Z) and Q(Z) are anti-resonance circuits and their output become O at $\omega_i$ and $\theta_i$. The frequency characteristic of $A_p(Z)$ becomes as follows:

$$|A_p(Z)|^2 = 2^p(\cos^2\frac{\omega}{2}\prod_{i=1}^{p/2}[\cos\omega - \cos\theta_i)^2 + \sin^2\frac{\omega}{2}\prod_{i=1}^{p/2}(\cos\omega - \cos\omega_i)^2] \quad (8)$$

where $Z=e^{-j\omega}$. It appears from the above expression (8) that in a region where adjacent line spectral frequencies are close to each other, $|A_p(Z)|^2$ is small and the transfer function H(Z) exhibits a strong resonance characteristic. By changing the values of the LSP parameters $\omega_i$ and $\theta_i$ describing the resonance characteristic of the transfer functions, an arbitrary speech spectral envelope can be obtained.

The procedure to derive the LSP parameters is as follows:

In the first step a speech wave of an input voice signal is A-D converted at sampling intevals of, for example, 0.1–0.125 m sec (8–10 KHz) to produce a sequence of samples S(n) which are passed through a window function w(n) to obtain a data sequence S'(n)+w(n) S(n). The interval of the window function is 10 to 20 m sec, for example. Secondly, the autocorrelation $V_p$ of S'(n) is calculated in accordance with $$V_p = \frac{1}{N}\sum_{i=1}^{N-p} S'(i) \times S'(i+p),$$

N being a number of samples in the window. In the third step the predictor coefficients $\{\alpha_p\}$ are calculated in accordance with the following matrix equation:

$$\begin{pmatrix} V_0 & V_1 & \dots & V_{p-1} \\ V_1 & \cdot & & \cdot \\ \cdot & \cdot & & \cdot \\ \cdot & \cdot & & \cdot \\ V_{p-1} & \dots & & V_0 \end{pmatrix} \begin{pmatrix} \alpha_1 \\ \alpha_2 \\ \cdot \\ \cdot \\ \cdot \\ \alpha_p \end{pmatrix} = - \begin{pmatrix} V_1 \\ V_2 \\ \cdot \\ \cdot \\ \cdot \\ V_p \end{pmatrix}$$

The abovementioned procedure is described in "Linear Prediction: A Tutorial Review" Proc. IEEE, vol. 63, April 1975, pages 126–129 in which expressions (17) and (37) correspond to above said expression of $V_p$ and the matrix equation, respectively. Thus, the predictor coefficients $\{\alpha_i\}$ i=1, 2, . . . p of the polynomial $A_p(Z)=-1+\alpha_1 Z+\alpha_2 Z^2+\dots+\alpha_p Z^p$ are determined. In the fourth step the roots of the polynomials P(Z) and Q(Z) defined by the expressions (3) and (4) respectively assuming zero are computed using the Newton method. The roots which render the polynomials P(Z) and Q(Z) to zero are represented by $Z=e^{\pm j\omega i}$ and $Z=e^{\pm j\theta i}$, respectively, and the sets of angular frequencies $\{\omega_i\}$ and $\{\theta_i\}$ are referred to as the LSP parameters. By controlling coefficients of the synthesis filter through utilization of the parameters representing the speech spectral envelope information, there can be obtained a filter whose transfer function H(Z) is equivalent to the speech spectral envelope. The transfer function of the feedback loop in the synthesis filter is provided in the form of a cascade connection of second-order filters, whose zeros are on a unit circle in a plane Z, as indicated by the expressions (5) and (6). Since these two second-order filters are identical in construction, the construction can also be simplified by multiple utilization of one second-order filter using time shared operation or what is called a pipeline operation. It is also possible to perform the filter operation by the processing of an electronic computer without forming the second-order filters as circuits.

As described above, in the present invention the characteristics of the synthesis filter are controlled by the aforesaid parameters $\omega_i$ and $\theta_i$ but, in addition to these LSP parameters $\omega_i$ and $\theta_i$, a fundamental frequency parameter and an amplitude parameter are employed as is the case with this kind of speech synthesizers heretofore used. The fundamental frequency parameter controls a voiced sound source to generate a pulse or a group of pulses of the frequency indicated by the parameter; the output from the voiced sound source or the output from a noise source is selected depending on whether the sound to be reconstructed is voiced or unvoiced; the selected output is applied to the sound synthesis filter; and the magnitude of a signal on the input or output side of the synthesis filter is controlled by the amplitude parameters. The LSP parameters $\omega_i$ and $\theta_i$ are subjected to cosine transformation by parameter transforming means to obtain $-2\cos\omega_i$ and $-2\cos\theta_i$, which are used as control parameters for controlling the coefficients of the second-order filters of the sound synthesis filter respectively corresponding to the parameters. The control parameters are interpolated by interpolating means in the form of the cosine-transformed LSP parameters $-2\cos\omega_i$ and $-2\cos\theta_i$. Also the interpolating means may be employed for the interpolation of the amplitude parameter. The LSP parameters $\omega_i$ and $\theta_i$ are excellent in interpolatability and the interpolation is conducted at time intervals equal to or twice the sampling period of the original sound for producing the parameters; for example, the LSP parameters $\omega_i$ and $\theta_i$ are updated every frame of 20 msec and the parameters in each frame are further interpolated every 125 μsec in the case of 8 KHz sampling. It is also possible to effect the interpolation in the state of the LSP parameters $\omega_i$ and $\theta_i$ and convert them to the control parameters.

The LSP parameters $\omega_i$ and $\theta_i$ are small in the amount of information per frame as compared with the control parameters used in a prior art synthesis filter for speech synthesis, and are excellent in interpolation characteristic. Accordingly, it is suitable to transmit or store the LSP parameters $\omega_i$ and $\theta_i$ as they are and it is also possible to convert the received or reconstructed LSP parameters $\omega_i$ and $\theta_i$ to the control parameters for the synthesis filter employed in other speech synthesizing systems, i.e. the PARCOR coefficients or linear predictor coefficients. In this way, the LSP parameters $\omega_i$ and $\theta_i$ can also be used in existing speech synthesizers. The sound synthesizer of the present invention is applicable to the synthesis of not only ordinary speech but also sounds such as a time signal tone, an alarm tone, a musical instrument sound and so forth.

DESCRIPTION OF THE PREFERRED EMBODIMENTS

Figure 1:
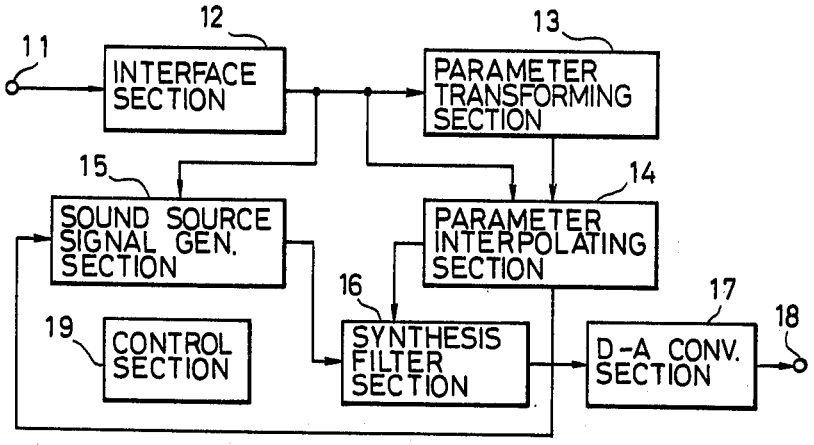
FIG. 1 is a block diagram showing the fundamental construction of an embodiment of the sound synthesizer of the present invention.

Referring first to FIG. 1, the feature parameters of a speech to be synthesized are applied from an input terminal 11 to an interface section 12 every constant period of time (hereinafter referred to as the frame period), for example, every 20 msec and latched in the interface section 12. Of the parameters thus input, the LSP parameters $\omega_i$ and $\theta_i$ indicating spectral envelope information are provided to a parameter transforming section 13; and, of parameters indicating sound source information, amplitude information is applied to a parameter interpolating section 14 and the other parameters, that is, information indicating the fundamental period (pitch) of the speech and information indicating whether the speech is a voiced or unvoiced sound are applied to a sound source signal generating section 15.

In the parameter transforming section 13, the input LSP parameters $\omega_i$ and $\theta_i$ are transformed into control parameters $-2\cos\omega_i$ and $-2\cos\theta_i$ for a synthesis filter section 16, which parameters are provided to the parameter interpolating section 14. In the parameter interpolating section 14, interpolation values for the control parameters and the sound source amplitude parameter are respectively calculated at regular time intervals so that the spectral envelope may undergo a smooth change. The control parameters thus interpolated are supplied to the synthesis filter section 16, and the sound source amplitude parameter is applied to the sound source signal generating section 15. In the sound source signal generating section 15, a sound source signal depending on the features of speech is produced on the basis of the pitch information and the voiced or unvoiced sound information, and the sound source signal thus obtained is applied to the synthesis filter section 16 together with the interpolated sound source amplitude parameter. In the synthesis filter section 16, a synthesized speech is produced from the sound source signal and the control parameters. The output from the synthesis filter section 16 is provided to a digital-analog converting section 17 and derived therefrom as an analog signal at its output terminal 18. A control section 19 generates various clocks for activating the speech synthesizer correctly and supplies them to the respective sections.

Figure 2:
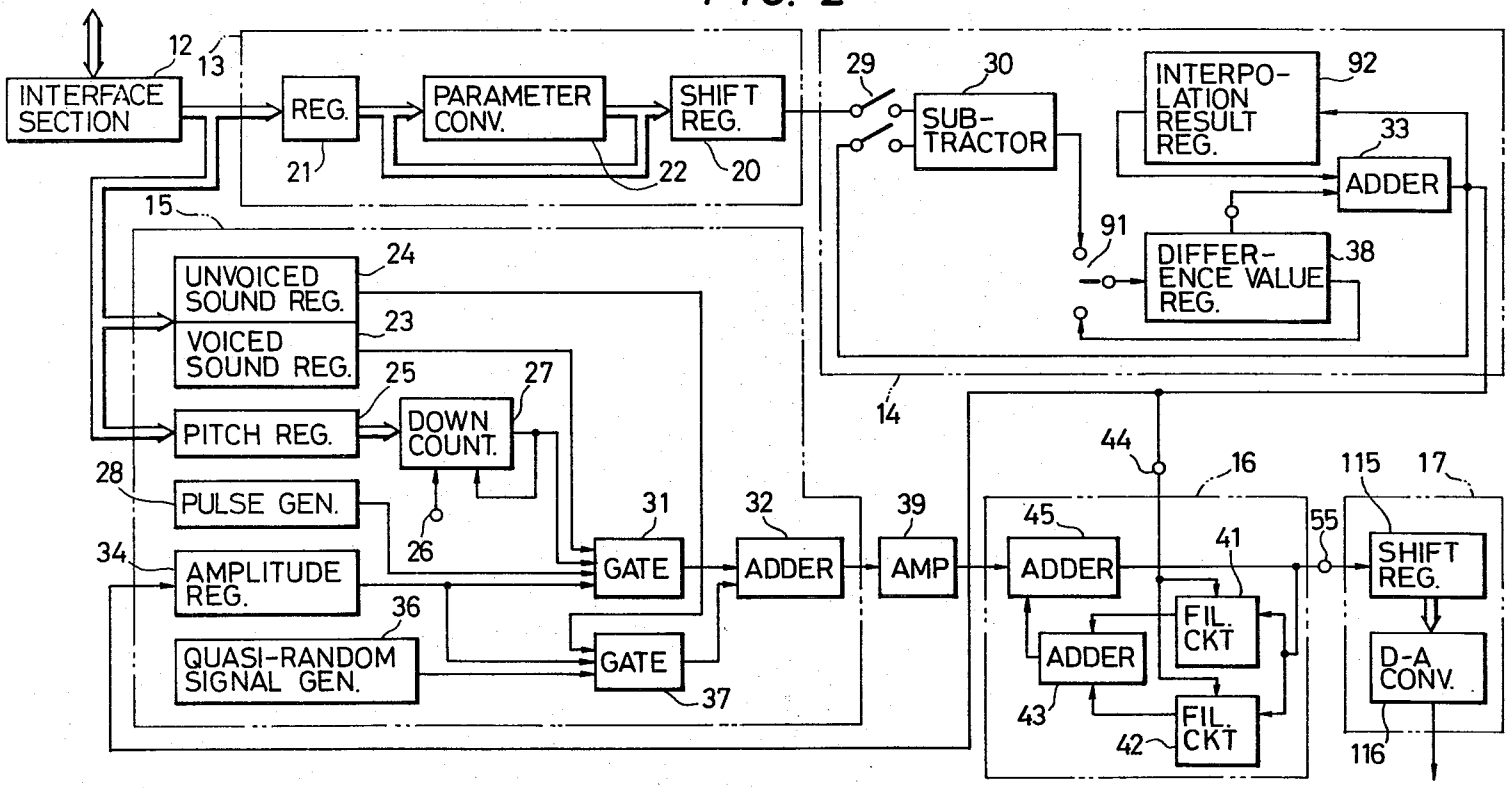
FIG. 2 is a block diagram showing a specific operative example of the sound synthesizer of the present invention.

FIG. 2 illustrates in greater detail each section of FIG. 1. Every frame period the information on the voiced or unvoiced sound of speech is applied from the interface section 12 to a voiced sound register 23 and an unvoiced sound register 24, and a voice frequency parameter indicating the voice pitch is stored in a pitch register 25. The content of the pitch register 25 is preset in a down counter 27. The down counter 27 counts down pulses of a sampling frequency from a terminal 26 and every time its content becomes zero, the counter 27 presets therein the content of the pitch register 25 and, at the same time, supplies one pulse to a gate 31. To the gate 31 are also applied the output from the voiced sound register 23 and an output pulse or pulses from a pulse generator 28, and when these inputs coincide, the content of a sound source amplitude register 34 is provided via the gate 31 to an adder 32. In other words, when the speech to be synthesized is a voiced sound, the amplitude information is applied to the adder 32 from the sound source amplitude register 34 every period of fundamental voice frequency of the pitch register 25, the amplitude information from the sound source amplitude register 34 being preset therein from the interpolating section 14.

In the case where the speech to be synthesized is an unvoiced sound, the output from the unvoiced sound register 24 and a pseudo random series pulse from a pseudo random signal generator 36 are provided to a gate 37, and upon every coincidence of both inputs, the amplitude information in the sound source amplitude register 34 is provided via the gate 37 to the adder 32. A sound source signal thus derived from the adder 32 is amplified, if necessary, by an amplifier 39 and then applied to the speech synthesis filter section 16.

In the parameter transforming section 13, the LSP parameters $\omega_i$ and $\theta_i$ and the amplitude parameter are set in a register 21 from the interface section 12 every frame period. The LSP parameters $\omega_i$ and $\theta_i$ are applied to a parameter converter 22, wherein they are transformed to control parameters $-2 \cos \omega_i$ and $-2 \cos \theta_i$. The parameter converter 22 is formed, for example, by a conversion table of a read only memory (ROM), which is arranged so that when accessed with addresses corresponding to $\omega_i$ and $\theta_i$, $-2 \cos \omega_i$ and $-2 \cos \theta_i$ are read out. A shift register 20 receives alternately the output from the parameter converter 22 and the amplitude parameter stored in the register 21 and converts then to a series signal, which is applied to the parameter interpolating section 14.

In the illustrated example, the parameter interpolating section 14 is shown to perform a linear interpolation. Upon turning ON a switch 29, the param of one frame are supplied to a subtractor 30, wherein a difference is detected between the parameter and that of the previous frame from an adder 33. The difference is stored in a difference value register 38 via a switch 91. Thereafter, the switch 91 is changed over to the output side of the difference value register 38 and the content thereof is circulated. At this time, the content of the difference value register 38 is taken out from bit positions higher than a predetermined bit position and supplied to the adder 33, wherein it is added to the content of an interpolation result register 92. For example, in the case of the parameter update period being 16 msec, if it is necessary to provide interpolation parameters 128 times during a frame update period, then the interpolation step width is a value obtained by dividing the difference value by 128 and this is obtained by shifting the difference value in the difference value register 38 towards the lower order side by seven bits. The result of addition by the adder 33 is provided to the interpolation result register 92 and, at the same time, it is used as the output from the parameter interpolating section 14. In this way, there are derived from the adder 33 the values that are obtained by sequentially adding values once, twice, three times, . . . the shifted value of the difference register 38 to the parameter of the previous frame in the interpolation result register 92 every circulation of the difference value register 38.

In this example, the parameter interpolating section 14 is used for the control parameter and the amplitude parameter on a time-shared basis, so that, though not shown, the control parameter and the amplitude parameter are alternately interpolated and the interpolation result register 92 is used in common to the both parameters. The amplitude parameter interpolated in the parameter interpolating section 14 is provided to the amplitude information register 34 in the sound source signal generating section 15, whereas the control parameter interpolated as mentioned above is applied to the speech synthesis filter section 16 as information for controlling its filter coefficient. The parameter update period, that is, the frame period, is selected to be in the range of 10 to 20 msec, and the interpolation period is selected to range from one to two sampling intervals. The interpolation method is not limited specifically to linear interpolation but may be other types of interpolation. The point is to ensure smooth variations of the interpolated parameters.

The synthesis filter section 16 is provided with a loop for feeding back the output through filter circuits 41 and 42 parallelly connected to each other. The filter circuits 41 and 42 are supplied with the interpolated control parameter from an input terminal 44 and the outputs from the filter circuits 41 and 42 are added together by an adder 43, the output from which is, in turn, added to the input to the filter section 16 in an adder 45. The added output therefrom is fed back to the filter circuits 41 and 42 and, at the same time, derived at an output terminal 55.

Figure 3A:
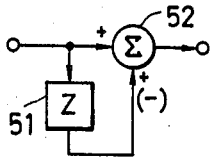
FIGS. 3A, 3B and 3C are circuit diagrams respectively showing an example of a first-order or second-order filter forming a synthesis filter section.
Figure 3B:
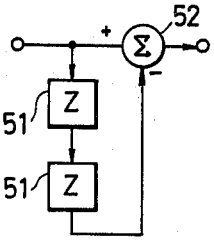
Figure 3C:
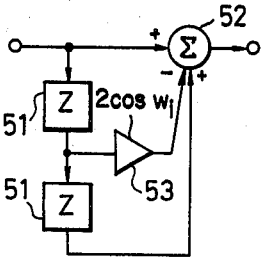

As each of the filter circuits 41 and 42, use is made of a circuit including cascade connected second-order filters each having zeros on a unit circle in a complex plane. The filter circuits 41 and 42 can be both formed by a multi-stage cascade connection of first-order and/or second-order filters. In the case of forming the filter circuits as digital filters, use can be made of a first-order filter such, for example, as shown in FIG. 3A which is composed of a delay circuit 51 having a delay of one sample period and an adder 52 for adding the delayed output and a non-delayed input. A second-order filter such as shown in FIG. 3B can also be used, which is composed of two stages of delay circuits 51 and the adder 52 for adding the delayed output and the non-delayed input and/or a second-order filter such as shown in FIG. 3C can be used in which the output from a multiplier 53 for multiplying the delayed output from one stage of delay circuit 51 by $-2 \cos \omega_i$, the delayed output from two stages of delay circuits 51 and the non-delayed input are added together by the adder 52. The transfer functions of the filters shown in FIGS. 3A, 3B and 3C are $1 \pm Z$, $1-Z^2$ and $1-2 \cos \omega_i Z+Z^2$, respectively. It is also possible to employ higher order filters.

Figure 4A:
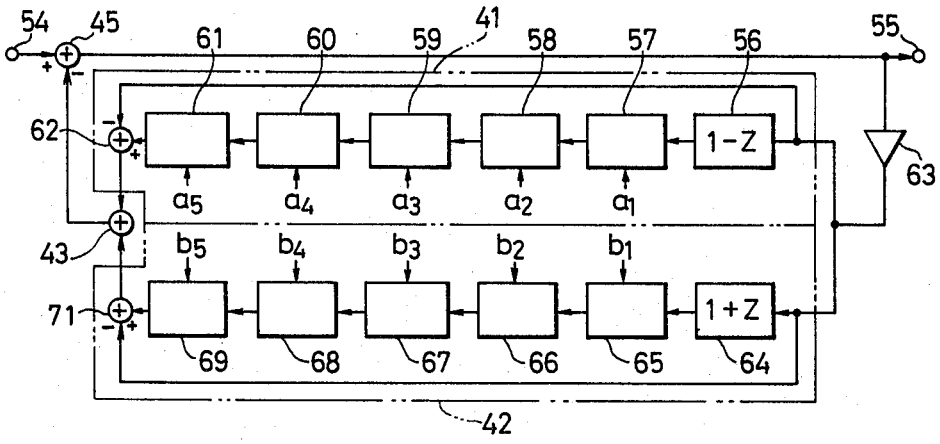
FIG. 4A is a diagram illustrating an example of the synthesis filter section where the degree of analysis is even.
Figure 4B:
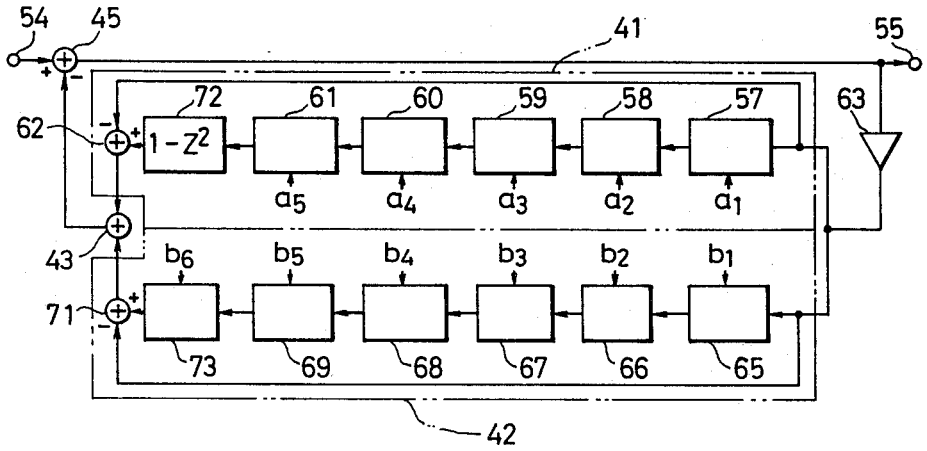
FIG. 4B is a diagram illustrating an example of the synthesis filter section where the degree of analysis is odd.

The combination and the number of such filters depend on the degree of analysis, and are selected as shown in FIG. 4A or 4B depending on whether the degree of analysis is even or odd. In FIG. 4A, the degree of analysis is 10, namely, an even number and the filter circuit 41 is constituted by a series connection of a first-order filter 56 having the transfer function 1-Z and second-order filters 57 to 61 each having the transfer function $1-2 \cos \omega_i Z+Z^2$, and the output at the output terminal 55 is multiplied by $+\frac{1}{2}$ in a multiplier 63 and applied to the series circuit 56-61. The output from the second-order filter 61 of the last stage and the output from the multiplier 63 are added together by an adder 62 and the added output therefrom is provided to the adder 43. In the filter circuit 42, the output from the multiplier 63 is supplied to another series circuit consisting of a first-order filter 64 having the transfer function $1+Z$ and second-order filters 65 to 69 each having the transfer function $1-2 \cos \theta_i Z+Z^2$, and the output from the series circuit 65-73 and the output from the multiplier 63 are added together in an adder 71, the added output from which is applied to the adder 43. The multipliers 53 of the second-order filters 57 to 61 are respectively given control parameters $a_1=-2 \cos \omega_1$ to $a_5 = -2 \cos \omega_5$ and the multipliers 53 of the second-order filters 65 to 69 are respectively given control parameters $b_1 = -2 \cos \theta_1$ to $b_5 = -2 \cos \theta_5$.

FIG. 4B shows the case where the degree of analysis is 11, namely, an odd number. In the filter circuit 41, the first-order filter 56 employed in the case of FIG. 4A is omitted but instead a second-order filter 72 having a transfer function $1-Z^2$ is used. In the filter circuit 42, the first-order filter 64 is omitted but instead a second-order filter 73 given a parameter $b_6 = -2 \cos \theta_6$ is used.

Figure 5:
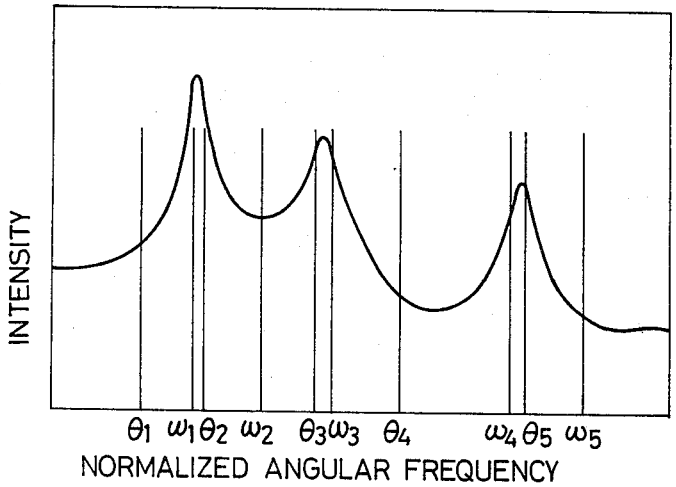
FIG. 5 is a diagram showing the relationship between the LSP parameters $\omega_i$ and $\theta_i$ and the speech spectral envelope.

In the filter circuits 41 and 42 the control parameters $\omega_i$ and $\theta_i$ represent anti-resonance frequencies, at which the outputs from the filter circuits 41 and 42 become 0.5. Accordingly, in the case where the anti-resonance frequencies applied to the filter circuits 41 and 42 are close to each other, the output from the adder 43 becomes close to unity and the feedback loop gain approaches unity. As a consequence, a high resonance characteristic appears at the output terminal 55. Here, $\omega_1$ to $\omega_5$ and $\omega_1$ to $\omega_5$ are anti-resonance frequencies, which are characteristic of the speech spectral envelope information. These parameters and the spectral envelope characteristic bear a relationship of the type depicted in FIG. 5, from which it appears that the resonance characteristic of the spectrum can be expressed by the spacing between adjacent parameters. These parameters have the following relationship of order:

$$0<\theta_1<\omega_1<\theta_2<\omega_2 \ldots <\theta_i<\omega_i<\pi \tag{8'}$$

The synthesizing filter has the feature that it is stable when the above condition is fulfilled.

Next, a description will be given of a specific operative example of the synthesis filter section 16. Corresponding to the term in the braces of the denominator in the experssion (7), the following identical equations are obtained from the expression (5):

$$P(Z) - 1 = (1 - Z) \prod_{i=1}^{p/2} (1 - 2\cos\omega_i Z + Z^2) - 1 \tag{9}$$

$$= Z\left\{ (a_1 + Z) + \sum_{i=1}^{p/2-1} (a_{i+1} + Z) \prod_{j=1}^{i} (1 + a_j Z + Z^2) - \prod_{j=1}^{p/2} (1 + a_j Z + Z^2) \right\}$$

$$Q(Z) - 1 = Z\left\{ (b_1 + Z) + \sum_{i=1}^{p/2-1} (b_{i+1} + Z) \prod_{j=1}^{i} (1 + b_j Z + Z^2) + \prod_{j=1}^{p/2} (1 + b_j Z + Z^2) \right\} \tag{10}$$

$$\left.\begin{aligned} a_i &= -2\cos\omega_i \\ b_i &= -2\cos\theta_i \end{aligned}\right\} \tag{11}$$

$$0 < \omega_i, \theta_i < \pi$$

Figure 6:
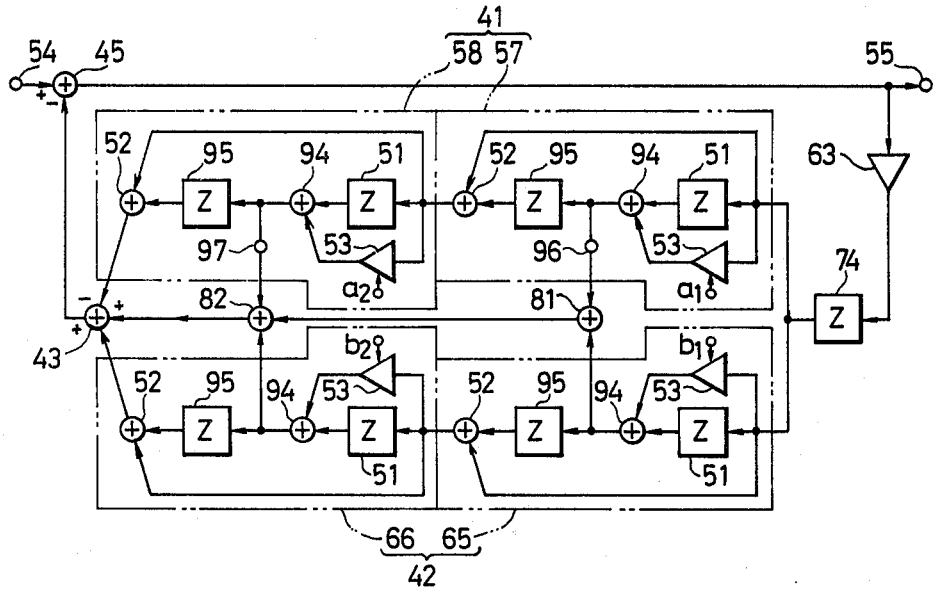
FIG. 6 is a circuit diagram illustrating a specific operative example of the synthesis filter section in the case of the degree of analysis being 4.

A digital filter is formed which has an all pole transfer function approximating the speech spectral envelope given by the expression (1) using the relationships given by the expressions (7), (9) and (10). FIG. 6 shows the case where P=4. In FIG. 6, parts corresponding to those in FIG. 4A are identified by the same reference numerals. The input from the terminal 54 is added by the adder 45 to the output from the adder 43, and the added output is provided to the output terminal 55 and, at the same time, multiplied by $+\frac{1}{2}$ in the multiplier 63. This $\frac{1}{2}$ multiplication corresponds to that in the denominator in the expression (7). The output from the multiplier 63 is applied to delay means 74 whose delay time is one sampling period, i.e. the unit time. The delayed output is applied as the input to each of the second-order filters 57 and 65, in which it is applied to the delay means 51, the multipliers 53 and the adders 52. In the two multipliers 53, the inputs thereto are respectively multiplied by $a_1$ and $b_1$, and the multiplied outputs are each applied to an adder 94 for addition with the output from the delay means 51 in each of the filters 57 and 65. The outputs from the two adders 94 are provided to a common adder 81 and, at the same time, applied to the adder 52 via delay means having a delay time of one sampling period in each of the filters 57 and 65. The outputs from the two adders 52 are respectively applied as the outputs from the filters 57 and 65 to the second-order filters 58 and 66 of the next stage. The filters 58 and 66 are identical in construction with the filters 57 and 65, but the coefficients for the multipliers 53 are $a_2$ and $b_2$, respectively. The output from the adder 94 of each filter is applied to an adder 82 for addition with the output from the adder 81. The outputs from the adders 52 of the filters 58 and 66 are supplied to the adder 43 for subtraction from each other, and the adder 43 is further supplied with the output from the adder 82.

The delay means 74 corresponds to Z outside the braces in the expressions (9) and (10), and the filters 57 and 58 each constitute a second-order filter having a transfer function $1+Z(a_j+Z)$, and similarly the filters 65 and 66 each constitute a second-order filter having a transfer function $1+Z(b_j+Z)$. Accordingly, the series connection of the second-order filters 57 and 58 realizes the third term in the braces in the expression (9), and the delay means 51, the multiplier 53 and the adder 94 in the filter 58 realize $(a_{i+1}+Z)$; consequently, by this circuit and the second-order filter 57, the second term in the braces in the expression (9) is realized, and the output is provided via the adder 82 to the adder 43. The delay means 51, the multiplier 53 and the adder 94 in the second-order filter 57 realize $(a_1+Z)$ and the output is supplied to the adder 43 via the adders 81 and 82. In this way, the terms in the braces in the expression (9) are realized by the second-order filters 57 and 58 and the adders 43, 81 and 82. Likewise, the terms in the braces in the expression (10) are realized by the second-order filters 65 and 66 and the adders 43, 81 and 81. The expressions (9) and (10) differ in form only in that the signs of the third terms in the braces are different from each other, and on account of this difference, the sign of the input to the adder 43 differs. Accordingly, the adder 43, the second-order filters 57, 58, 65 and 66, the multiplier 63 and the delay means 74 realize the expression (2), and the circuit arrangement of FIG. 6 materializes the expression (1) as a whole. In this circuit arrangement, the expressions (9) and (10) are materialized by forming the filter circuit 41 with a series connection of (P/2)'s second-order filters 57 and 58 and the filter circuit 42 with a series connection of (P/2)'s second-order filters 65 and 66 in the feedback loop, by taking out the nodes of the second-order filters of the filter circuit 41, that is, taps 96 and 97, from the output sides of the adders 94 to obtain the total sums with the adders 81, 82 and 83. The arrangement for taking out outputs from the taps of the filter circuits will hereinafter referred to as the tap output type.

Figure 7:
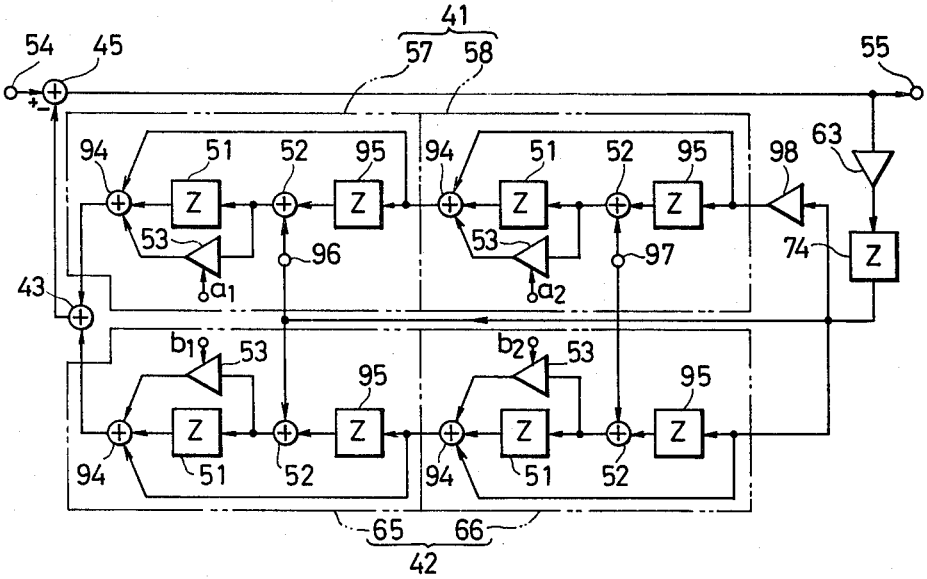
FIG. 7 is a circuit diagram illustrating a specific operative example of the synthesis filter section obtained by an equivalent conversion of the circuit shown in FIG. 6.

In FIG. 6, the second-order filters are arranged towards the adder 43 in an increasing order of the value j but they may also be arranged in a decreasing order of the value j. In such a case, for example, as shown in FIG. 7, the output from the delay means 74 is provided to the second-order filters 58 and 66, the outputs from which are applied via the second-order filters 57 and 65 to the adder 43. In FIG. 7, the preceding stage of each second-order filter in FIG. 6 is exchanged with the succeeding stage; namely, the circuit 94 for adding together the outputs from the delay means 51 and the multiplier 53 is exchanged with the delay means 95. The output from the delay means 74 is provided via the taps 96 and 97 to the nodes of the second-order filters 57 and 58. In other words, the circuit arrangement of FIG. 6 is the tap output type, whereas the circuit arrangement of FIG. 7 is a tap input type. The circuit beginning with the tap 96 and ending with the adder 43 constitutes the first term in the braces of the expression (9), and the circuit from the tap 97 to the adder 43 constitutes the second term in the braces of the expression (9). The second-order filters 65 and 66 of the filter circuit 41 are also similarly formed. In connection with the filter circuit 41, the output from the delay means 74 is multiplied by $-1$ in a multiplier 98 to materialize the minus sign for the third term in the braces of the expression (9).

In the case where p is odd, the following identical equation is obtained from the expression (8) corresponding to the term in the braces of the denominator in the expression (7).

$$P(Z) - 1 = Z\left\{ (a_1 + Z) + \sum_{i=1}^{(p-3)/2} (a_{i+1} + Z) \prod_{j=1}^{i} (1 + a_jZ + Z^2) - Z \prod_{j=1}^{(p-1)/2} (1 + a_jZ + Z^2) \right\} \quad (12)$$

$$Q(Z) - 1 = Z\left\{ (b_1 + Z) + \sum_{i=1}^{(p-1)/2} (b_{i+1} + Z) \times \prod_{j=1}^{i} (1 + b_jZ + Z^2) \right\} \quad (13)$$

$$\left.\begin{array}{l} a_i = -2\cos\omega_i \\ b_i = -2\cos\theta_i \\ 0 < \omega_i, \theta_i < \pi \end{array}\right\} \quad (14)$$

Figure 8:
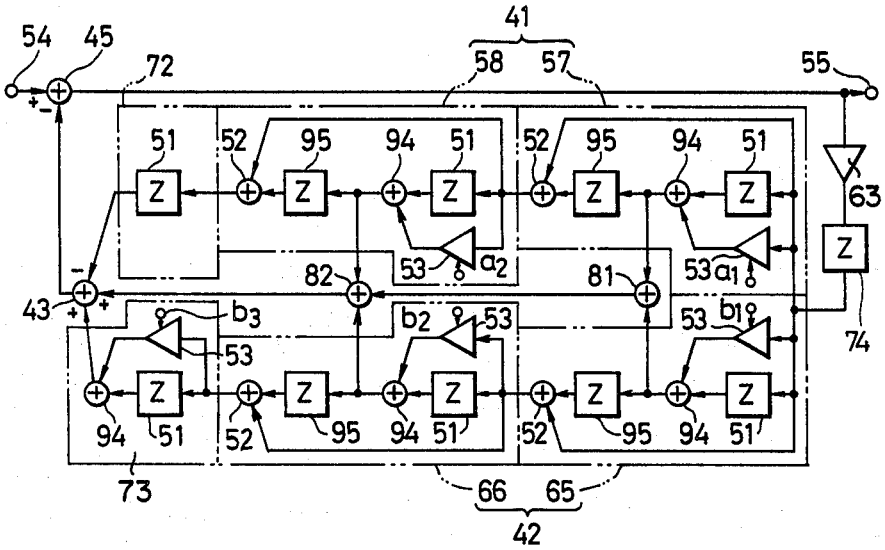
FIG. 8 is a circuit diagram showing a specific example of the synthesis filter section in the case of the degree of analysis being 5.
Figure 9:
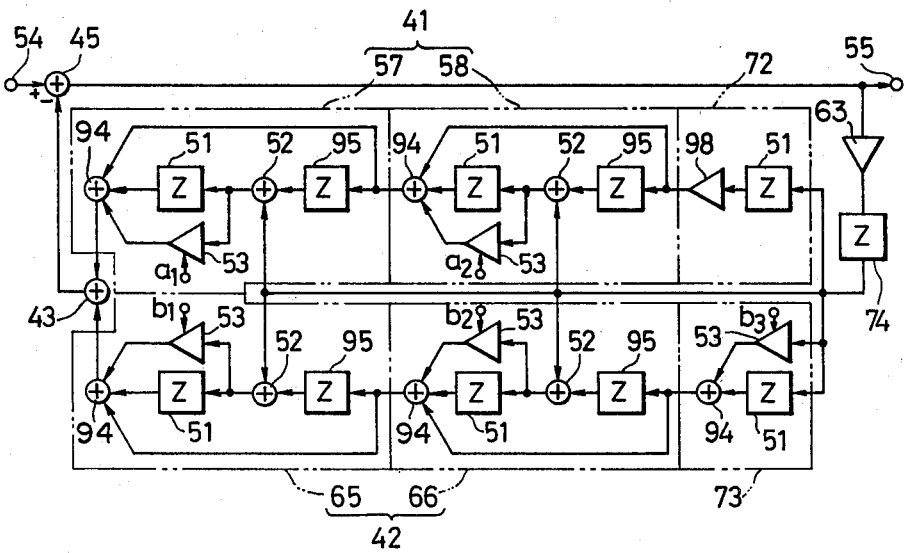
FIG. 9 is a circuit diagram showing a specific operative example of the synthesis filter section obtained by an equivalent conversion of the circuit shown in FIG. 8.

As in the case of p being even, described above, when p is odd two types of digital filters respectively called the tap output type and the tap input type are materialized in such forms as shown in FIGS. 8 and 9 from the relations of the expressions (7), (12) and (13). In FIGS. 8 and 9, it is assumed that p is 5. In FIGS. 8 and 9, the first-order filter 72 corresponds to Z in the third term in the braces of the expression (13) and the second-order filter 73 is to obtain such a characteristic that the products of the transfer functions $(1+b_1Z+Z^2)$ and $(1+b_2Z+Z^2)$ of the filters 65 and 66 is multiplied by $(b_3+Z)$.

Figure 10:
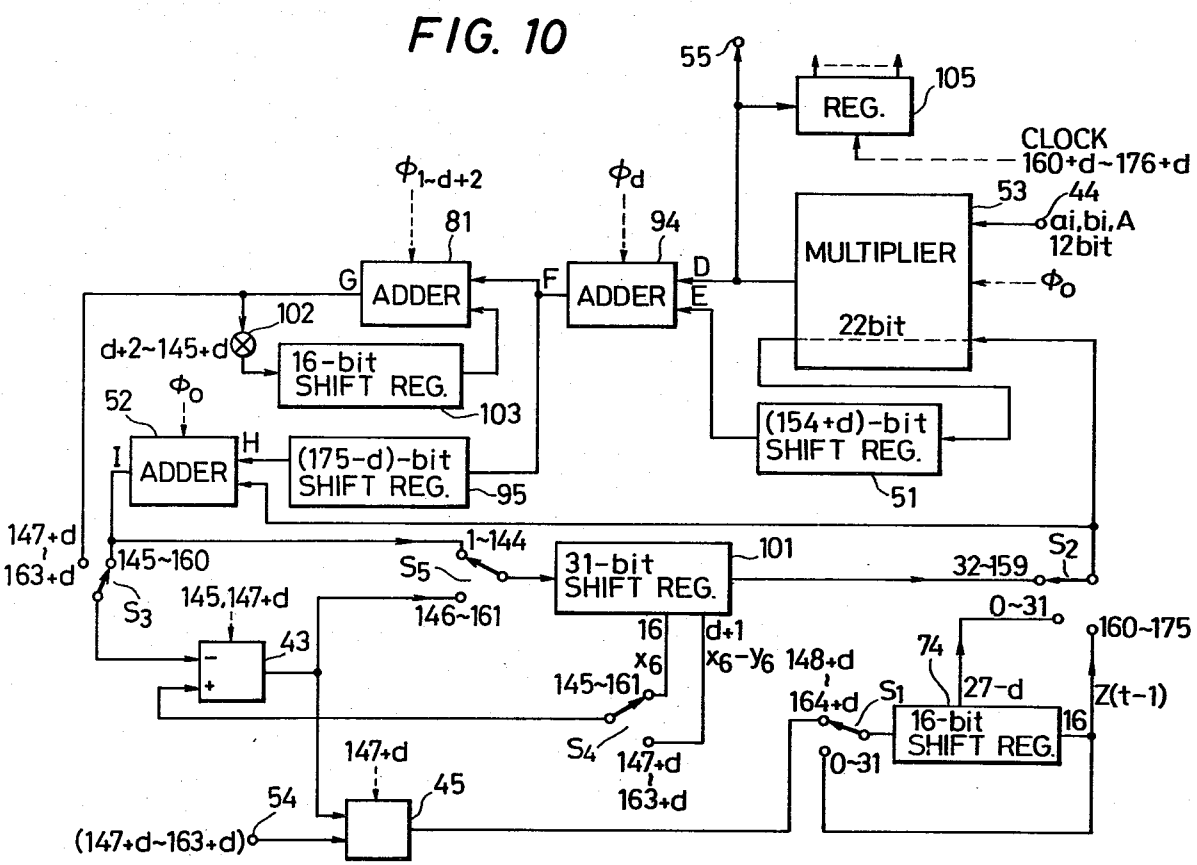
FIG. 10 is a block diagram illustrating an example of the synthesis filter section employing the pipeline calculation system.
Figure 12:
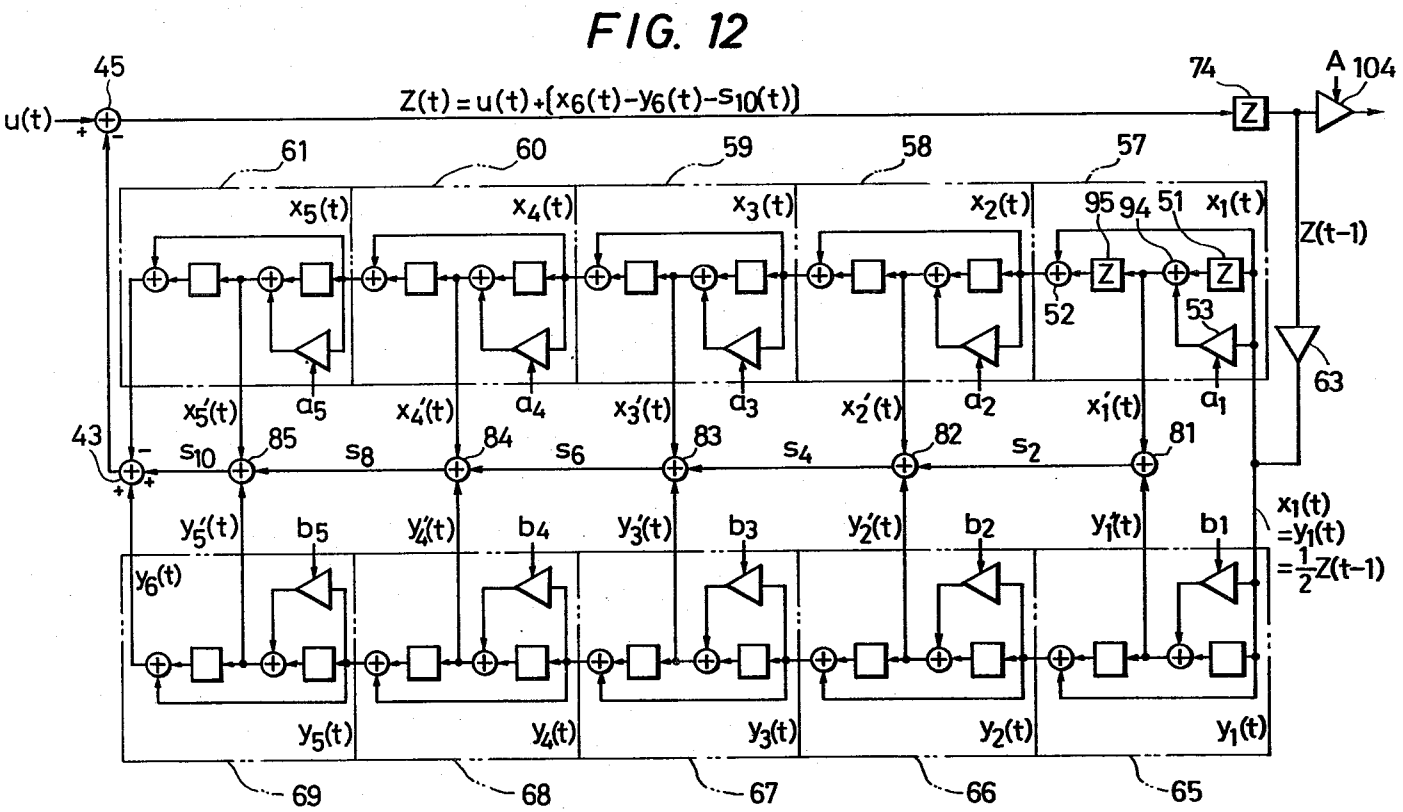
FIG. 12 is a circuit diagram showing the case in which the filter operation achieved by the operation shown in FIG. 11 is provided by a series connection of filters.

As will be understood from FIGS. 6 to 9, the $+\frac{1}{2}$ multiplier 63 and the delay means 74 may also be disposed at any places in the feedback loop. Since the second-order filters are of the same type, it is possible to simplify hardware by forming the circuit arrangement so that the so-called pipeline operation is effected by using, on a time-division multiplex basis, one multiplier 53, the plurality of adders 52 and 94 and the plurality of delay means 51 and 95 making up one second-order filter. FIG. 10 illustrates the case where the example of the filter shown in FIG. 12 is arranged to conduct the pipeline operation. In this example, p=10, and an operation of a set of parameters applied from the interpolating section is completed with a period of 176 clocks. In FIG. 10, parts coresponding to those in FIG. 12 are marked with the same reference numerals. The input side of a 16-bit static shift register 74, which performs the function of the delay means 74 is changed over by a switch $S_1$ between the output side of the shift register itself and the output side of the adder 45. A multiplicand input side of the multiplier 53 and the input side of the adder 52 are changed over by a switch $S_2$ to the output side of the shift register 74, the output side of a (27-d)th shift stage counted from the input of the shift register 74 and the output side of a 31-bit shift register 101, d being an operation delay of the multiplier 53. The multiplier 53 is connected at one end to the output terminal 55 and the input side of the adder 94 and derives at the other output end the multiplicand input delayed by 22 clocks, which is provided to the (154+d)-bit shift register 51. The output from an adder 81 is fed back to the input side thereof via a gate 102 and a 16-bit shift register 103, performing a cumulative addition through the adders 81 and 82 in FIG. 10. The gate 102 is opened only in the time interval between d+2 and 145+d. One input side of the adder 43 is changed over by a switch $S_3$ between the output sides of the adders 52 and 81, and the other input side of the adder 43 is changed over by a switch $S_4$ between the output sides of a 16th and a (d+1)th shift stages of the shift register 101. The input side of the shift register 101 is changed over by a switch $S_5$ between the output sides of the adders 43 and 52.

Figure 11:
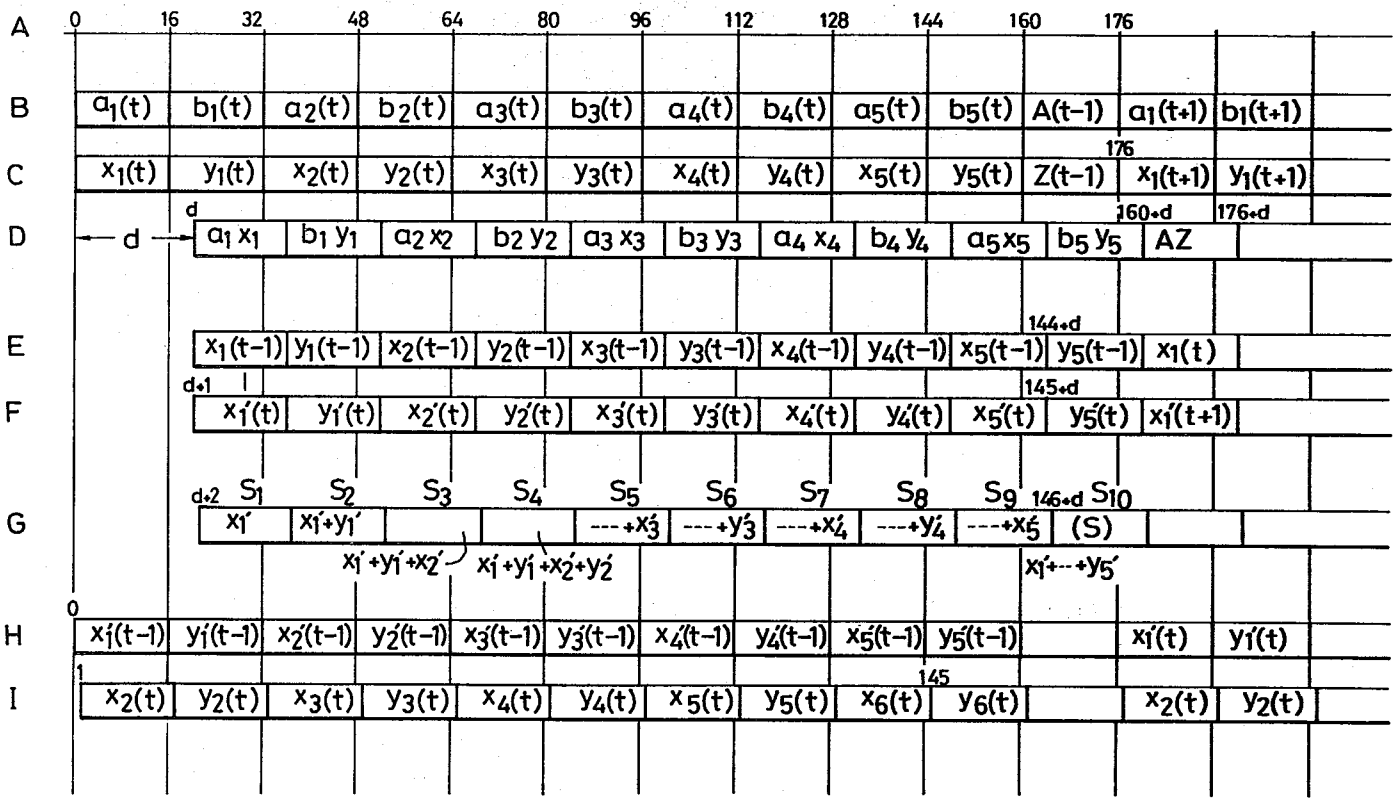
FIGS. 11A to 11I, inclusive, are timing charts showing the variations of signals appearing at respective parts during the operation of the filter section depicted in FIG. 10.

The switches $S_1$ to $S_5$ are each connected to the fixed contact side, during one operation period, that is, 176 clocks, for a clock period indicated by numerals labelled at the fixed contact. The shift registers 51, 95, 101 and 103 are respectively of the (154+d)-bit, (175−d)-bit, 31-bit and 16-bit dynamic type and are always supplied with shift clocks. The broken line input to each of the adders 43, 45, 52, 81 and 94 indicates the timing of the operation boundary of each parameter; for example, $\phi_0$ indicates a repetition every 16 clocks and an operation delay of each adder is selected to be one clock. FIG. 11 is a timing chart of the operation of each part in FIG. 10, FIG. 11A showing the timing of the clock, FIG. 11B the inputs of the interpolated coefficients $a_i$, $b_i$ and the interpolated amplitude A to the multiplier 53 from the input terminal 44, FIG. 11C the multiplicand of the multiplier 53, FIG. 11D one input to the adder 94 from the multiplier 53, FIG. 11E the other input to the adder 94, FIG. 11F the output from the adder 94, FIG. 11G the output from the adder 81, and consequently the content of the register 103, FIG. 11H the input to the adder 52 from the shift register 95, and FIG. 11I the output from the adder 52. FIG. 12 shows these inputs and outputs in the form of signals appearing at the respective parts in the case where the second-order filters are cascade-connected.

As shown in FIG. 11, in the period between clocks O and 16, a coefficient $a_1(t)$ and a multiplicand $x_1(t)$ are muliplied in the multiplier 53 to effect the multiplication in the second-order filter 57 in FIG. 12, and the result of multiplication is obtained from a dth clock. In the period between clocks 16 and 32, as shown in FIGS. 11B and 11C, a coefficient $b_1(t)$ and a multiplicand $y_1(t)$ are multiplied to perform the multiplication in the second-order filter 65. The multiplicand $x_1(t)$ is delayed by the shift register 51 along with 22 bits of the multiplier 53 by (176+d) clocks, so that as shown in FIG. 11E, a multiplicand $x_1(t-1)$ is applied to the adder 94 from the dth clock and added with the output $a_1x_1$ derived from the multiplier 53 at that time, and the added output $x_1'(t)$ is provided via the adder 81 to the shift register 103 for accumulation. That is, the output from the adder 81 is supplied to the signal system of the adders 81, 82, . . . in FIG. 12.

The output from the adder 94 is also provided to the (175−d)-bit shift register 95, as shown in FIG. 11H. Accordingly, in the period between the clocks 0 and 16, the output from the shift register is $x_1'(t-1)$, as shown in FIG. 11H, and this output is added with the multiplicand $x_1(t)$ in the adder 52, the output $x_2(t)$ from which is applied as the input to the second-order filter 58 in FIG. 12. The output $x_2(t)$ from the adder 52 is provided via the shift register 101 to the multiplier 53. As shown in FIG. 11C, the output $x_2(t)$ is multiplied by the coefficient $a_2(t)$ in the multiplier 53 in the period between clocks 32 to 48. Prior to this multiplication, $b_1(t)$ and $y_1(t)$ are multiplied, as described previously, and the multiplied output is similarly processed, thereby to obtain the output $y_2(t)$ from the second-order filter 65 in the period between clocks 48 and 64. In this way, the multiplication of the coefficient a and the multiplicand x and the multiplication of the coefficient b and the multiplicand y are carried out alternately every 16 clocks, and the multiplied results are applied to the shift register 51, as indicated by $a_1x_1$, $b_1y_1$, $a_2x_2$, $b_2y_2$, . . . in FIG. 11D. Further, the second-order filters 57, 58, 59, 60 and 61 respectively derive therefrom $x_1'(t)$, $x_2'(t)$, $x_3'(t)$, $x_4'(t)$, $x_5'(t)$ and $x_2(t)$, $x_3(t)$, $x_4(t)$, $x_5(t)$, $x_6(t)$, which are provided to the shift registers 95 and 101. Similarly, $y_1'(t)$ to $y_5'(t)$ and $y_2(t)$ to $y_6(t)$ are respectively obtained from the second-order filters 65 to 69, and these outputs are applied to the shift registers 95 and 101 alternately with $x'(t)$ and $x(t)$, respectively. In the period between clocks 145 and 161, the output $y_6$ derived from the adder 52 at that time and $x_6$ in the shift register provided previously are subtracted one from the other in the adder 43, and $(x_6-y_6)$ is supplied via the switch $S_5$ to the shift register 101, wherein it is delayed by (d+1) clocks. The delayed output is taken out from the switch $S_4$ for input to the adder 43 in the period between clocks 147+d and 163+d. The output yielded from the shift register 103 at that time is provided to the adder 43 via the adder 81 and the switch $S_3$. The output from the adder 43 at that time becomes the output from the adder 43 in FIG. 12 and this output is applied to the adder 45, wherein it is added with the input at the terminal 54 to provide Z(t). The added output Z(t) is supplied to the register 74, wherein it is delayed by the delay means 74 in FIG. 12. The delayed output is applied to the multiplier 53 and at that time the coefficient A is provided as an amplitude interpolation output at the terminal 44 and A·Z(t) is derived from the multiplier 53 at the output terminal 55. This multiplication is performed in the case where the output from the synthesis filter section 16 is multiplied by the amplitude information A in a multiplier 104 in FIG. 12. From the shift register 74 is taken out an output Z(t)/2 having shifted down by one bit and this is taken out via the switch $S_2$ to the multiplier 53 as Z(t−1)/2, that is, x(t) and y(t), in the next subsequent operation period for a new set of the parameters. The output at the output terminal 55 can also be obtained as parallel outputs through an output buffer 105 of a static shift register.

Figure 13:
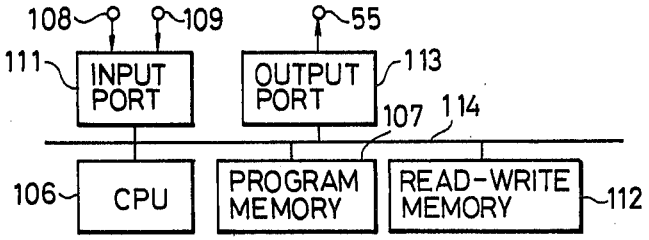
FIG. 13 is a block diagram illustrating an example of the synthesis filter using a microcomputer.

The pipeline operation described above is also applicable to other types of synthesis filter section 16. Furthermore, as will be appreciated from the arrangement of FIG. 10, the filter operation can be achieved by addition, multiplication and delay, so that this filter processing can also be effected using a microcomputer. For example, in FIG. 13, by successively reading out, interpreting and executing programs in a program memory 107, a central processor unit 106 loads therein from an input port 111 a sound source signal and control parameters respectively applied from the sound source signal generating section 15 and the interpolating section 14 to terminals 108 and 109, and the central processor 106 sequentially performs the operations described previously with regard to FIG. 11. A read-write memory 112 is used instead of the registers 51, 74, 95, 101, 103 and 105 in FIG. 10. The results of the operations are written in the read-write memory 112 and read out therefrom at suitable timing to perform operations. The output thus obtained is applied from an output port 113 to the output terminal 55. The central processor 106, the memories 107 and 112 and the ports 111 and 113 are connected to a bus 114.

By any one of the abovesaid methods the output from the synthesis filter section 16 is obtained. The output is converted by the D-A converting section 17 in FIG. 2 to an analog signal to provide a speech output. In the D-A converting section 17, if the input thereto is a serial signal, then it is applied to a shift register 115 and the content of the shift register 115 is converted by a D-A converter 116 to analog form.

Figure 14A:
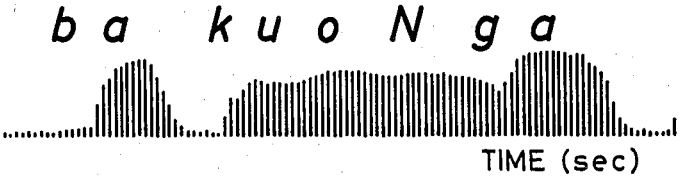
FIG. 14A is a diagram showing the variations of power with the lapse of time in the case where a speech "ba ku o N ga" was made.
Figure 14B:
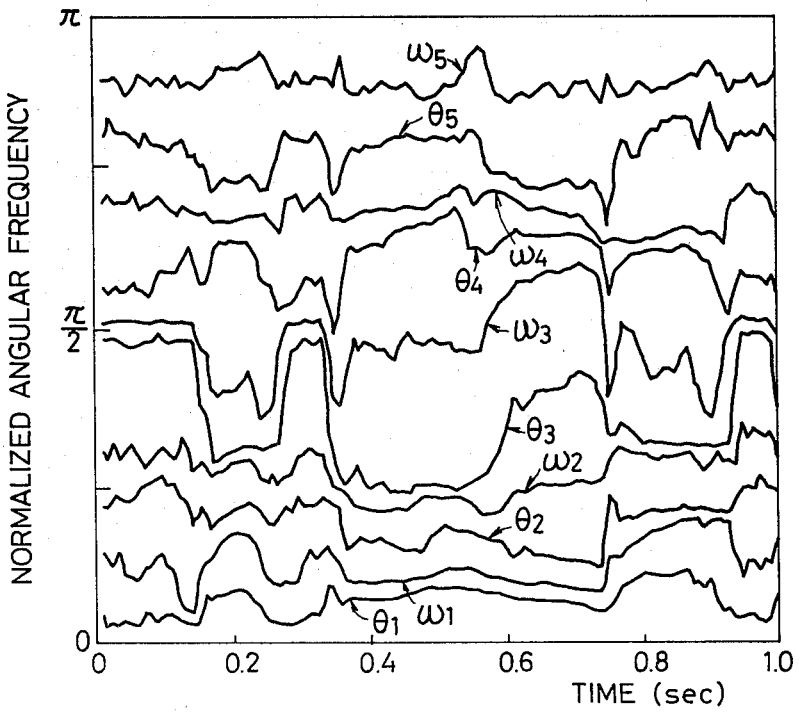
FIG. 14B is a diagram showing the fluctuations in the LSP parameters $\omega_i$ and $\theta_i$ with the lapse of time in the case where the speech "ba ku o N ga" was made.
Figure 15:
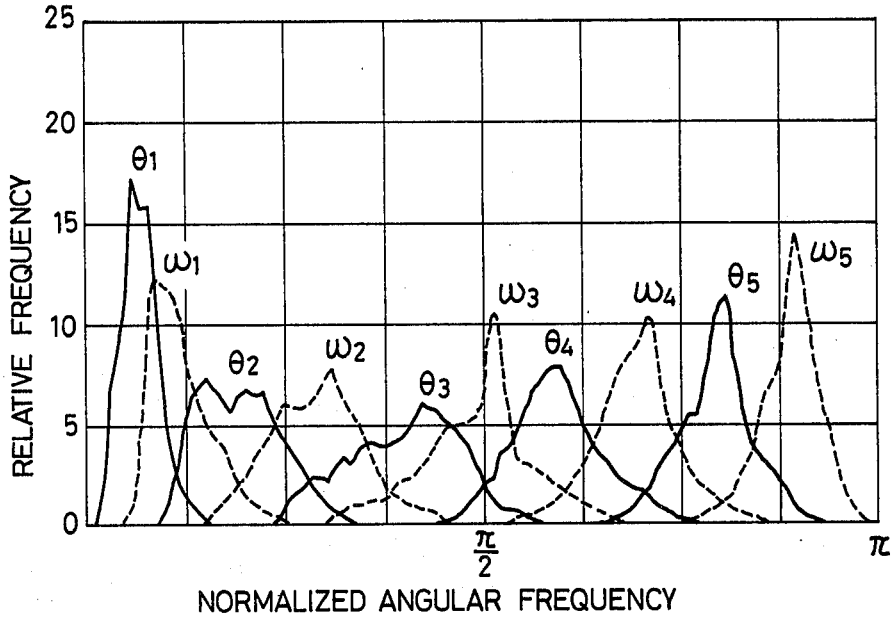
FIG. 15 is a diagram showing the relative frequency distributions of the LSP parameters $\omega_i$ and $\theta_i$ to frequency.

As described previously, the LSP parameters $\omega_i$ and $\theta_i$ in the speech feature parameters used in the present invention can be obtained by obtaining the solutions of the expressions (5) and (6). In FIGS. 14A and 14B there are shown the results of analysis of a speech "bakuoNga" using the LSP parameters $\omega_i$ and $\theta_i$. In FIGS. 14A and 14B, the abscissa represents time t, in FIG. 14A the ordinate represents power, and in FIG. 14B the ordinate represents normalized angular frequency. Seeing instantaneous points in FIG. 14B, the frequency rises in the order of parameters $\theta_1$, $\omega_1$, $\theta_2$, $\omega_2$, . . . $\theta_5$, $\omega_5$, this order does not change and the parameters $\theta_i$ and $\omega_i$ do not coincide with each other in one frame. Accordingly, it is guaranteed that the synthesizing filter section 16 is always stable. The frequency distributions of the LSP parameters $\theta_i$ and $\omega_i$ are shown in FIG. 15, in which the abscissa represents normalized angular frequency f and the ordinate the relative frequency D. As shown in FIG. 15, each parameter is not distributed over a wide frequency band but is restricted to a relatively narrow frequency band, so that the LSP parameters $\omega_i$ and $\theta_i$ can be quantized in connection with the frequency range in which they are distributed.

Figure 16:
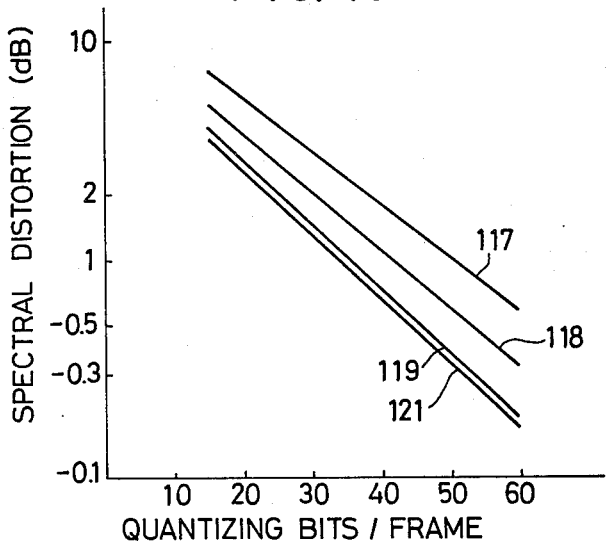
FIG. 16 is a diagram showing the relationship between the number of quantizing bits per frame and the spectral distortion by quantization.

The LSP parameters $\omega_i$ and $\theta_i$ are small in quantizing distortion. FIG. 16 shows a spectral distortion $D_S$ of a synthesized speech when various parameters were quantized variously, the abscissa representing the number of quantizing bits B per frame and the ordinate the spectral distortion $D_S$. The line 117 shows the case where in consideration of only the parameter distribution, the PARCOR coefficient is quantized linearly only in the coefficient that was distributed; th line 118 shows the case where the number of quantizing bits for the PARCOR coefficient was increased in consideration of the spectral sensitivity in addition to the parameter distribution in the case of the line 117, especially in the case of markedly affecting the spectrum; the line 119 shows the case where the LSP parameters $\omega_i$ and $\theta_i$ were quantized in consideration of only the parameter distribution; and the line 121 shows the case where the LSP parameters $\omega_i$ and $\theta_i$ were quantized in consideration of the parameter distribution and the spectral sensitivity. It wil be seen from FIG. 16 that in the case of using the same number of quantizing bits, the spectral distortion becomes smaller in the order of the lines 117, 118, 119 and 121. Since the lines 119 and 121 are close to each other, the LSP parameters $\omega_i$ and $\theta_i$ are not so much affected in spectral distortion even if the spectral sensitivity is not taken into account. Accordingly, since it is sufficient to perform the quantization taking into consideration the parameter distribution range alone, the quantization is easy. The value that the number of quantizing bits per frame at which the spectral distortion is 1 dB in the case of the line 119 is divided by that number of quantizing bits in the case of the line 117 is 0.7. Similarly, the ratio of the number of quantizing bits per frame at which the spectral distortion is 1 dB between the lines 118 and 121 is 0.8. From this, it will be understood that the LSP parameters $\omega_i$ and $\theta_i$ are excellent. One dB is a difference limen of the spectral distortion of a synthesized speech.

Figure 17:
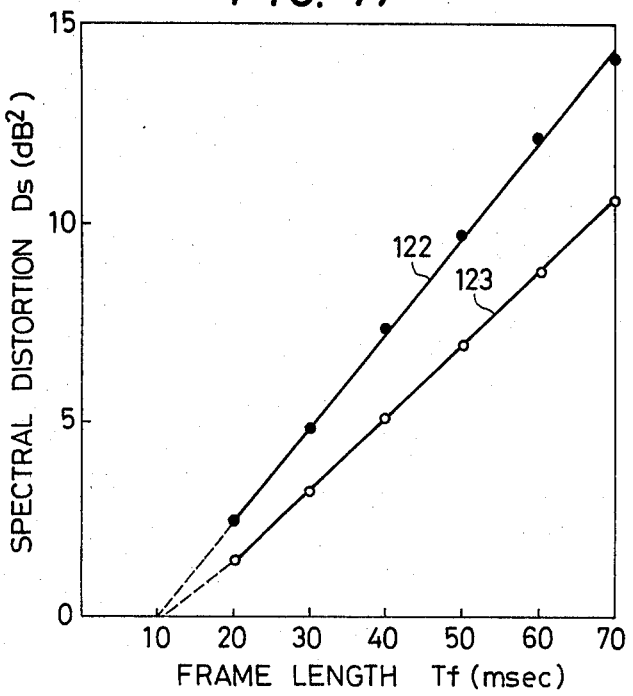
FIG. 17 is a diagram showing the relationship of the spectral distortion by interpolation to the frame length in the case of the parameters having been interpolated.

FIG. 17 shows interpolation characteristics, the abscissa representing a frame length $T_f$ and the ordinate the spectral distortion $D_S$. FIG. 17 shows the spectral distortion of a synthesized speech in the case where a frame in which an original speech was analyzed in 10 msec was used as the reference, the frame length was increased to 20 to 70 msec and parameters were interpolated every 10 msec. The line 122 shows the case where use was made of the PARCOR coefficients, and the line 123 shows the case where use was made of the LSP parameters $\omega_i$ and $\theta_i$. As will be seen from FIG. 17, in the case of the same distortion, the frame length $T_f$ can be made longer by the LSP parameters than the frame length $T_f$ by the PARCOR coefficients, that is, the parameter update period can be increased, so that the entire amount of information can be reduced by that. In addition, since the LSP parameters are smaller than the PARCOR coefficients in the number of bits per frame, as seen from FIG. 16, the amount of information for the same distortion may be reduced by the product of the reduction ratios in FIGS. 16 and 17; namely, in the case of the LSP parameters, the amount of information may be about 60% of that in the case of the PARCOR coefficients.

In the case of employing the LSP parameters, it is meaningless as in the cases of other parameters that they are interpolated with a shorter period than the sample period of the original speech used in the making of the parameters. Experiments revealed that the interpolation period might be about twice or less the sample period of the original speech, but that when the former was about four times the latter, noises were introduced to make the synthesized speech indistinct. Accordingly, it is preferred that the interpolation period be equal to or twice the original speech sampling period.

As has been described in the foregoing, the LSP parameters are relatively easy to automatically extract, and consequently can be extracted on a real time basis. Furthermore, the LSP parameters are excellent in the interpolation characteristic and small in deviation of the quantizing characteristic and permits transmission and storage of speech in a small amount of information. In the speech synthesis, speech of high quality can be reconstructed and synthesized with a small amount of information, and as long as the relationship of the expression (8') holds true, the stability of the synthesizing filter is quaranteed.

In FIG. 2, it is also possible to widen the spectrum by generating from the pulse generating section 28 a train of pulse groups, such as the Barker series, instead of the pulse train. The interpolating section 14 may also be provided at the preceding stage of the parameter transforming section 13. Namely, the LSP parameters from the interface section 12 may also be subjected to the cosine transformation in the parameter transforming section 13 after being interpolated. In this case, the use of a read only memory is uneconomical since its memory capacity must be enormous; accordingly, it is preferred to perform parameter conversion using an approximation operation of the cosine rather than using the read only memory as described in the example of FIG. 2. In FIG. 2, the information indicating whether speech is a voiced or unvoiced sound is entered and loaded in the voiced sound register 23 and the unvoiced sound register 24, but this information need not always be provided. That is, a detector circuit is provided for detecting whether the fundamental period parameter applied to the pitch register 25 is zero or not; in the case of detecting zero, the sound is considered to be an unvoiced sound and the gate 37 is opened; and in the case of other values than zero, the sound is considered to be a voiced sound and the gate 31 is opened. The control by the amplitude parameter may also be effected in connection with the output from the filter section 16, as described previously with respect to the embodiment of FIG. 12.

Figure 18:
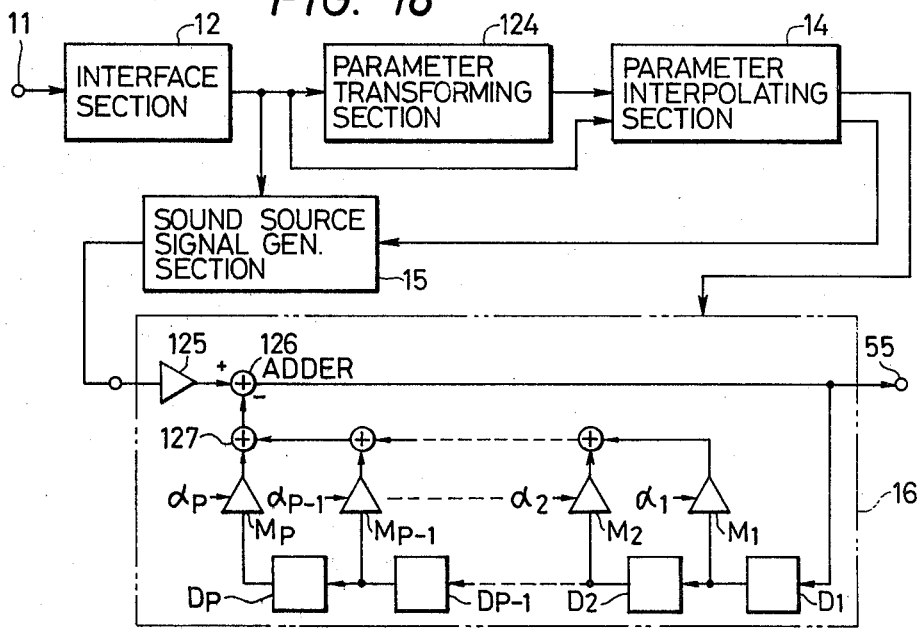
FIG. 18 is a diagram showing an example of synthesizing speech by converting the LSP parameters $\omega_i$ and $\theta_i$ to $\alpha$ parameters.

In the foregoing, as the synthesis filter, use is made of a filter which includes in the feedback circuit the means for connecting in series a plurality of first-order and second-order filters of different coefficients, each having the zero on a unit circle, through utilization of the LSP parameters. However, the synthesis filter need not always be limited specifically to such a filter and the speech synthesis may also be effected by transforming the LSP parameters to some other types of parameters and using other filters. For example, as shown in FIG. 18 in which parts corresponding to those in FIG. 1 are identified by the same reference numerals, the fundamental period parameter in the feature parameters applied to the interface section 12 is provided to the sound source signal generating section 15, and the amplitude parameter is supplied to the interpolating section 14. The amplitude parameter thus interpolated is applied to the sound source signal generating section 15, in which it is processed as described previously in respect to FIG. 2, providing a sound source signal to the synthesis filter section 16. The LSP parameters are supplied to an LSP parameter transforming section 124, in which they are transformed to other types of parameters, such as an $\alpha$ parameter, PARCOR parameter or the like. For example, from the LSP parameters are obtained polynomials P(Z) and Q(Z) using the expression (5) or (6), and from the polynomials the predictor coefficients $\alpha_i$ of the transfer function H(Z) are obtained using the expressions (1) and (2). By interpolating the thus obtained predictor coefficients $\alpha_i$ in the interpolating section 14 as required, the characteristics of the sound snythesis filter section 16 are controlled. The filter section 16 is formed, for example, as a cyclic filter, in which, as shown in FIG. 18, the sound source signal from the second source signal generating section 15 is made $\sigma$-fold by a multiplier 125 and applied to an adder 126 for subtraction from the output of an adder 127 and the output from the adder 126 is provided to the output terminal 55. The output thus derived at the output terminal 55 is applied to a series circuit of delay circuits $D_l$ to $D_p$, each having a delay time of one sample period. The outputs from the delay circuits $D_l$ to $D_p$ are respectively multiplied by coefficients $\alpha_l$ to $\alpha_p$ from the interpolating section 14 in multipliers $M_l$ to $M_p$. The multiplied outputs are sequentially added and then added together in the adder 127.

It will be apparent that many modifications and variations may be effected without departing from the scope of the novel concepts of this invention.

We claim:

1. A sound synthesizer comprising:

a sound source signal source for generating a sound source signal;

a control parameter source for delivering control parameters $a_i$, $b_i$ ($i=1, 2, 3\ldots$) for controlling the characteristic of a synthesis filter, said control parameters $a_i$, $b_i$ being expressed by $a_i=-2\cos\omega_i$ and $b_i=-2\cos\theta_i$ where $\omega_i$ and $\theta_i$ are LSP parameters and $0<\theta_1<\omega_1<\theta_2<\omega_2<\theta_3\ldots<\pi$; and all-pole type synthesis filter means for synthesizing a sound signal under the control of said control parameters, said all-pole type synthesis filter means comprising: feedback adder means one input of which is supplied with said sound source signal, and first and second feedback means the input side of each of which is supplied with the output from said synthesis filter means and the output of each of which is supplied to another input of said feedback adder means thereby to provide first and second feedback loops, said first and second feedback means respectively including in the feedback paths thereof first cascade operating second-order filter means expressed by $(1+a_iZ+Z^2)$ and second cascade operating second-order filter means expressed by $(1+b_iZ+Z^2)$ where Z represents unit time delay means.

2. A sound synthesizer according to claim 1, wherein the sound source signal source is composed of a fundamental period sound source controlled by a fundamental period parameter to generate a pulse or a pulse group of the period indicated by the parameter, a noise source for generating random pulses, and means for selecting the output from the fundamental period sound source or the output from the noise source depending on whether speech to be synthesized is a voiced or unvoiced sound.

3. A sound synthesizer according to claim 1 or 2, further comprising amplitude control means for controlling the magnitude of a signal at the input or output side of the synthesis filter means by an amplitude parameter.

4. A sound synthesizer according to any one of claims 1 or 2, wherein each of said first and second-order filter means comprises first delay means for delaying the input to the second-order filter means for a unit time, second delay means for delaying the output from said first delay means for a unit time, multiplier means for multiplying the output from said first delay means and a corresponding one of said control parameters, and first adder means for adding together the multiplied output, the output from the second delay means and the input to said first delay means to provide the output from the second-order filter means.

5. A sound synthesizer according to any one of claims 1, or 2, wherein each of said first and second-order filter means comprises first delay means for delaying the input to the second-order filter means for a unit time, multiplier means for multiplying the input to said first delay means and a corresponding one of said control parameters, first adder means for adding the multiplied output and the output from said first delay means, and second delay means for delaying the added output from said second delay means and the input to said first delay means to provide the output from the second-order filter means.

6. A sound synthesizer according to claim 4, wherein the second-order filter means is formed as a second-order digital filter circuit; and the second-order digital filter circuit is used on a multiplex basis by a pipeline operation system by operating the filter circuit a plurality of times within a unit time and changing the coefficient of the filter circuit for each operation.

7. A sound synthesizer according to claim 1, further comprising interpolating means for interpolating said control parameters $a_i$ and $b_i$ and supplying them to said synthesis filter means.

8. A sound synthesizer comprising:

a sound source signal source for generating a sound source signal;

a LSP parameter source for generating LSP parameters $\{\omega_i\}$ and $\{\theta_i\}$ expressed in angular frequencies respectively allowing the roots of polynomials P(Z) and Q(Z) assuming zero and defined by the following expressions:

$$P(Z)=A_p(Z)-Z^{p+1}A_p(Z^{-1})$$

$$Q(Z)=A_p(Z)+Z^{p+}A_p(Z^{-1})$$

$$A_p(Z)=1+\alpha_1Z+\alpha_2Z^2+\ldots+\alpha_pZ^p$$

where $\{\alpha_i\}$ are predictor coefficients determined from each predetermined number of samples of soundware signal;

parameter transforming means for transforming the LSP parameters to control parameters of a type different from the LSP parameters; and a sound synthesis filter means having a transfer function $H(Z)=\sigma/A_p(Z)$, said sound synthesis filter means being supplied with the sound source signal from said sound source signal source while the characteristics thereof are controlled by the transformed control parameters.

9. A sound synthesizer according to claim 8, wherein the sound source signal source is composed of a fundamental period sound source controlled by a fundamental period parameter to generate a pulse or a pulse group of the period indicated by the parameter, a noise source for generating random pulses, and select means for selectively taking out the output from the fundamental period sound source or the output from the noise source depending on whether a sound to be synthesized is a voice or unvoiced sound.

10. A sound synthesizer according to claim 8 or 9, further comprising amplitude control means for controlling the magnitude of a signal at the input or output side of the sound synthesis filter means by an amplitude parameter.

11. A sound synthesizer according to claim 8 or 15 wherein said parameter transforming means is means for transforming said LSP parameters $\omega_i$, $\theta_i$ to predictor coefficients $\alpha$, and wherein said sound synthesis filter means comprises: first adder means one input of which is supplied with said sound source signal; a cascade connection of a plurality of unit time delay means, the input of said cascade connection being connected to the output of said first adder means; a plurality of multiplier means each for multiplying the output of one of said unit time delay means and corresponding one of said predictor coefficients $\alpha_1$; and second adder means for summing up all the outputs from said multiplier means and supplying the sum to another input of said first adder means.

12. A sound synthesizer according to claim 5 wherein the second-order filter means is formed as a second-order digital filter circuit; and the second-order digital filter circuit is used on a multiplex basis by a pipeline operation system by operating the filter circuit a plurality of times within a unit time and changing the coefficient of the filter circuit for each operation.

13. A sound synthesizer according to claim 1, 2, or 7, wherein each of said first and second cascade-operating second-order filter means comprises a plurality of cascade-connected second-order filters each of which is composed of first delay means for delaying the input to the second-order filter for a unit time, first adder means supplied with the delayed output from said first delay means and the output from the synthesis filter means to produce a sum thereof, second delay means for delaying the output sum from said first adder means for a unit time, multiplier means for multiplying the sum output from said first adder means and a corresponding one of said control parameters, and second adder means for adding together the multiplied output from said multiplier means, the output from said second delay means and the input to the second order filter to thereby produce the output from the second-order filter, and wherein said first feedback means further comprises a multiplier at the input side thereof in series thereto for multiplying $-1$ to the input to said first feedback means, and said first and second feedback loops include loop delay means inserted in series thereto for delaying the input to the loop delay means for a unit time.

14. A sound synthesizer according to claim 13 wherein said first feedback means further comprises a first first-order filter inserted at the input side of said first feedback means in series thereto, said second feedback means further comprising a second first-order filter at the input side thereof, said second first-order filter comprising a second delay circuit for delaying the input to said second feedback means for a unit time, a second multiplier for multiplying the input to said second feedback means and a corresponding one of the control parameters, and an adder circuit for adding the delayed output from said second delay circuit and the multiplied output from said second multiplier to produce the output of said second first-order filter.

15. A sound synthesizer according to claim 1, 2, or 7, wherein each of said first and second cascade-operating second-order filter means comprises a plurality of cascade-connected second-order filters each of which is composed of first delay means for delaying the input to the second-order filter for a unit time, multiplier means for multiplying the input to the second-order filter and a corresponding one of the control parameters, first adder means for adding the multiplied output and the delayed output from said first delay means, second delay means for delaying the added output from said first adder means for a unit time, second adder means for adding the output from said second delay means and the input to the second-order filter to thereby produce the output from the second-order filter, and means for summing up said added output from said first adder means and the output of each of said first and second cascade-connected second-order filter means, said first and second feedback loops including loop delay means inserted in series thereto for delaying the input to the loop delay means for a unit time.

16. A sound synthesizer according to claim 15 wherein said first feedback means further comprises a first first-order filter inserted at the output side of said first feedback means in series thereto, said second feedback means further comprising a first-order filter at the output side thereof, said first-order filter comprising a second delay circuit for delaying the input thereto a unit time, a second multiplier for multiplying the input to said second delay circuit and a corresponding one of the control parameters, and an adder circuit for adding the delayed output from said second delay circuit and the multiplied output from said second multiplier to produce the output of said first-order filter.

17. A sound synthesizer according to claim 1, wherein the function of said all-pole type synthesis filter means is materialized through interpreting and executing a program using a computer.

18. A sound synthesizer according to claim 1 wherein said control parameter source comprises parameter generating means for generating said LSP parameters $\omega_i$ and $\theta_i$, and parameter transforming means for producing said control parameters $a_i$ and $b_i$ by performing cosine transformation of said LSP parameters $\omega_i$ and $\theta_i$.

19. A sound synthesizer according to claim 18 wherein said control parameter source further comprises interpolating means for interpolating said LSP parameters $\omega_i$ and $\theta_i$ from parameter generating means and supplying the interpolated LSP parameters $\omega_i$ and $\theta_i$ to said parameter transforming means for cosine transformation thereof.

20. A sound synthesizer according to claim 7 or 19 wherein the interpolation period in said interpolating means is equal to or twice the unit time period of said unit time delay means.

21. A sound synthesizer according to claim 3 further comprising interpolating means for interpolating said control parameters $a_i$ and $b_i$ and supplying them to said synthesis filter means, said interpolating means being used on a multiplex basis for the interpolations of both said control parameters $a_i$, $b_i$ and said amplitude parameter.

22. A sound synthesizer according to claim 3 wherein said control parameter source comprises parameter generating means for generating said LSP parameters $\omega_i$ and $\theta_i$, interpolating means for interpolating said LSP parameters $\omega_i$ and $\theta_i$ from said parameter generating means, and parameter transforming means for receiving said interpolated LSP parameters $\omega_i$ and $\theta_i$, producing the interpolated parameters of said control parameters $a_i$ and $b_i$ by performing cosine transformation of said interpolated parameters $\omega_i$ and $\theta_i$, and supplying said interpolated control parameters $a_i$ and $b_i$ to said synthesis filter means for control thereof.

23. A method of synthesizing sound comprising the steps of:

extracting, from an original sound signal, sound source signal parameters representing a sound source signal for energizing a synthesis filter means having a transfer function H(Z) defined by $$H(Z) = \frac{\sigma}{A_p(Z)} = \frac{\sigma}{1 + \alpha_1 Z + \alpha_2 Z^2 + \ldots + \alpha_p Z^p}$$

extracting features parameters $\{\omega_i\}$ and $\{\theta_i\}$ representing the feature of the original sound signal;

transforming the feature parameters $\{\omega_i\}$ and $\{\theta_i\}$ to control parameters $\{a_i\}$ and $\{b_i\}$ in accordance with $a_i = -2 \cos \omega_i$ and $b_i = -2 \cos \theta_i$;

generating a sound source signal in accordance with the sound source signal parameters;

supplying the sound source signal to said synthesis filter means to energize it; and controlling the characteristics of said synthesis filter means by the control parameters $\{a_i\}$ and $\{b_i\}$ thereby producing a synthesized sound signal from said synthesis filter means;

the step of extracting feature parameters $\{\omega_i\}$ and $\{\theta_i\}$ comprising the steps of:

sampling the original sound signal at a predetermined period $\Delta T$;

obtaining auto correlation coefficients from the samples in a predetermined time interval;

calculating predictor coefficients $\{\alpha_i\}$ (i=1, 2, . . . p) from the auto correlation coefficients to determine the function $A_p(Z)$;

calculating the feature parameters $\{\omega_i\}$ and $\{\theta_i\}$ which render polynomials P(Z) and Q(Z) to zero, the polynomials P(Z) and Q(Z) being defined by $$A_p(Z) = \tfrac{1}{2}\{P(Z) + Q(Z)\}$$

$$P(Z) = A_p(Z) - Z^{p+1} A_p(Z^{-1})$$

$$Q(Z) = A_p(Z) + Z^{p+1} A_p(Z^{-1})$$

where $Z = e^{-j\omega}$, $\omega$ is a normalized angular frequency $2\pi f \Delta T$ and p is the degree of analysis, and said synthesis filter means comprises two feedback paths respectively having transfer functions $P(Z) - 1$ and $Q(Z) - 1$ including cascade operating second-order filter means represented by $(1 + a_i Z + Z^2)$ and $(1 + b_i Z + Z^2)$, respectively.

24. A sound synthesizer according to claim 17 wherein said first feedback means further comprises a multiplier at the input side thereof in series thereto for multiplying $-1$ to the input to said first feedback means, said first and second feedback loops include loop delay means inserted in series thereto for delaying the input to said loop delay means for a unit time, and each of said first and second second-order filter means comprises tap-input adder means inserted between the output side of said first delay means and the input sides of both said second delay means and multiplier means for adding the input to both said multiplier and said second feedback path and the output from said first delay means and supplying the added output from said tap-input means to both the input sides of said second delay means and said multiplier means.

25. A sound synthesizer according to claim 24 wherein said first feedback path includes a unit time delay in series with said multiplier for delaying the input to said first feedback path for a unit time, and said second feedback path includes in series therewith at its input side first-order filter means expressed by $(Z + b_i)$ and composed of delay means for delaying the input to said second feedback path for a unit time, multiplier means for multiplying the input to said second feedback path and a corresponding one of said control parameters $b_i$, and adder means for adding the outputs from said multiplier means and said delay means to supply the added output to said second cascade operating second-order filter means.

26. A sound synthesizer according to claim 5 wherein said first and second feedback loops include loop delay means inserted in series therewith for delaying the input to said loop delay means for a unit time, and each of said first and second second-order filter means comprises tap-output adder means for summing the outputs from said first adder means of respective said first and second second-order filter means and additively supplying the sum to said feedback adder means.

27. A sound synthesizer according to claim 26 wherein said first feedback path includes a unit time delay at the output side of said first cascade operating second-order filter means in series thereto for delaying the output from said first cascade operating second-order filter means for a unit time, and said second feedback path includes in series thereto at its output side first-order filter means expressed by $(Z + b_i)$ and composed of delay means for delaying the output from said second cascade operating second-order filter means for a unit time, multiplier means for multiplying the output from said second cascade operating second-order filter means and a corresponding one of said control parameters $b_i$, and adder means for adding the outputs from said delay means and said multiplier means to produce the output from said second feedback path.

* * * * *